United States Patent [19]

Paxman

[11] Patent Number: 4,457,514

[45] Date of Patent: Jul. 3, 1984

[54] DARTS

[76] Inventor: Colin J. Paxman, 5 Fieldings Rd., Cheshunt, Hertfordshire EN8 9TL, England

[21] Appl. No.: 432,363

[22] Filed: Sep. 30, 1982

[51] Int. Cl.[3] ..... A63B 65/02

[52] U.S. Cl. ..... 273/420; 273/423

[58] Field of Search ..... 273/416, 419, 420, 423

[56] References Cited

U.S. PATENT DOCUMENTS 4,101,126 7/1978 Kurtz et al. ..... 273/419 X

FOREIGN PATENT DOCUMENTS 583296 10/1924 France ..... 273/420
566343 12/1944 United Kingdom ..... 273/420
591882 9/1947 United Kingdom ..... 273/423
736644 9/1955 United Kingdom ..... 273/420
1139853 1/1969 United Kingdom ..... 273/420
1491811 11/1977 United Kingdom ..... 273/423

*Primary Examiner*—Paul E. Shapiro
*Attorney, Agent, or Firm*—Emory L. Groff, Jr.

[57] ABSTRACT

A dart comprises a point portion 1, a barrel portion 2, a shaft 3 and a flight 4. The point portion 1 is detachably secured within the barrel portion 2 by a screw thread 8 provided at one end of the point portion 1 and a corresponding screw thread provided at one end 9 of the barrel portion 2. The shaft 3 is detachably secured to the other end of the barrel at 11 by screw thread 12. This enables the point or the shaft to be selectively connected with either end of the barrel whereby the dart may be made to have two different flight characteristics. In a second embodiment the barrel has different size screw threads at each end, and two points and two shafts are provided. One shaft and one point have a screw to match one end of the barrel and the other shaft and point have screw threads to match the other end of the barrel. The barrel of both embodiments has an asymmetrical longitudinal shape.

3 Claims, 3 Drawing Figures

DARTS

This invention relates to darts and more particularly to darts of the type which may be used for throwing at a target in the game commonly known as "darts".

According to this invention there is provided a kit of parts for forming a dart, the kit comprising: a barrel which is longitudinally assymetric and which has two ends; point means for connection to the barrel, said point means being such that an elongate point can be secured detachably to a first said end of the barrel, and said point means being such that an elongate point can be secured detachably to a second said end of the barrel; shaft means for connection to the barrel, said shaft means being such that one end of a shaft can be secured detachably to said first end of the barrel, and said shaft means being such that one end of a shaft can be secured detachably to said second end of the barrel; and flight means adapted to be secured detachably to the other end of the said shaft; the arrangement being such that, from the said kit, a dart can be made comprising a point secured detachably to one said end of the barrel and a shaft and flight secured detachably to the other said end of the barrel, and, alternatively, such that a dart may be made comprising a point secured detachably to the said other end of the barrel, and a shaft and flight secured detachably to the said one end of the barrel.

It will be appreciated that from a kit of parts as defined above a dart may be constructed in which, when the dart is thrown, the barrel advances in one direction, and also an alternative dart can be constructed in which, when the dart is thrown, the barrel advances in the opposite direction. Thus, from the single kit of parts, a person playing a game of darts can assemble two darts having different flight characteristics.

Preferably, the point means comprises a single point adapted to be secured detachably to either end of the barrel, and the shaft means comprises a single shaft adapted to be secured detachably to either end of the barrel. Alternatively, the point means comprises at least two points, a first said point being adapted to be detachably secured only to a first end of the barrel and a second said point being adapted to be detachably secured only to the second end of the barrel, and the shaft means comprises at least two shafts, a first said shaft being adapted to be detachably secured only to a first end of the barrel and a second said shaft being adapted to be detachably secured only to the second end of the barrel.

Suitably, for the or each point, the adaptation for detachably securing comprises a screw thread to engage a corresponding screw thread on the barrel. Advantageously, for the or each shaft, the adaptation for detachably securing comprises a screw thread to engage a corresponding screw thread on the barrel. Preferably, in the alternative embodiment described above, the diameter of the said screw thread at one end of the barrel is different from the diameter of the screw thread at the other end of the barrel.

Conveniently, the or each point comprises an elongate sharp member and a securing member in permanent engagement with one end of the said sharp member. Advantageously, the securing member is made from a plastics material such as nylon, but alternatively the securing portion is made of a metal such as brass. Preferably, the barrel portion is longitudinally asymmetric with regard to weight.

So that this invention may be more readily understood and so that further features may be appreciated, darts in accordance with the invention will now be described by way of example and with reference to the accompanying drawings in which.

Figure 1:
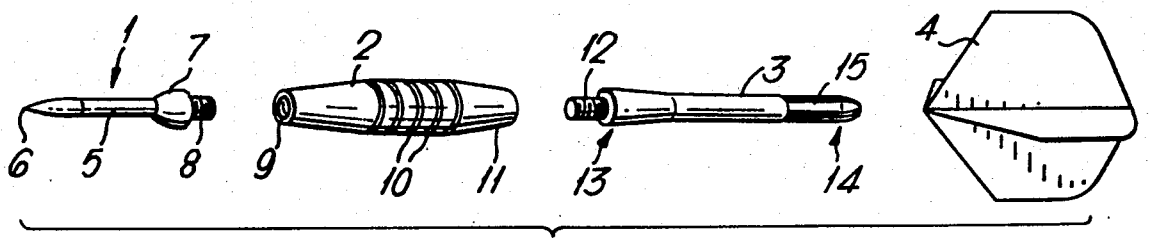
FIG. 1 is a side elevation of a dart in accordance with the invention, with the various components thereof exploded away from one another.

The dart illustrated in FIG. 1 comprises four main parts, namely a point portion 1, a barrel portion 2, a shaft 3 and a flight 4, all arranged along a common axis.

The point portion 1 is constructed from an elongate generally cylindrical steel "point" 5, with one end 6 thereof tapering sharply, and a securing member 7 which is permanently attached to the end of the point 5 remote from the sharp end 6. The securing member 7 is made of nylon, is of generally axial construction, and is provided with an axial blind bore to accommodate the point 5. The securing member 7 is provided with a collar having and external screw thread 8 which is adapted to be engaged with a corresponding internal screw thread provided at a first end 9 of the barrel portion 2. A portion of the securing member 7 which is not provided with the screw thread 8 flares from the diameter of the point 5 to the diameter of the said first end 9 of the barrel portion 2, so that, when the point portion 1 is thus screwed into the barrel portion 2, a smooth contour is provided from the point 5 to the barrel portion 2.

The barrel portion 2 is an elongate generally cylindrical tungsten or brass rod, the central diameter of which is slightly greater than the two end diameters thereof. The middle of the barrel portion 2 is provided with five spaced apart circumferential grooves 10, the purpose of which grooves 10 is to facilitate the gripping of the dart when the dart is about to be thrown.

At the second end 11 of the barrel portion 2, remote from the end 9 into which the point portion 1 may be screwed, there is an axial blind bore provided with an internal screw thread adapted to engage a corresponding external screw thread 12 at one end 13 of the shaft 3.

The shaft 3 is made of a plastics material such as nylon and is in the form of generally cylindrical axially extending rod. At the end 14 of the shaft 3 remote from the screw thread 12 thereof, two mutually perpendicular intersecting diametric slots 15 extend along the shaft 3 for about one quarter of its length. These slots 15 are adapted to accommodate and to grip, by means of friction, a portion of the flight 4. The flight is of conventional design, comprising two substantially identical mutually perpendicular and mutually bisecting planar vanes.

In use, various parts of a dart commonly suffer the most frequent damage: the flight 4 is generally of a light and delicate construction and is easily deformed so that the dart no longer travels in the direction intended, the shaft 3 is often made of a light material and can be damaged if it is hit by the point of another dart, and the point portion 1 may suffer damage, for example as a result of striking the wire framework which delineates portions of the target at which the dart is being thrown, or by being dropped on the floor. The point portion is usually made of strong but brittle steel, and thus tends to snap off.

It is known for the flight of a dart to be readily detached from the shaft and to be replaced by a new flight, and it is known for the shaft of a dart to be readily removable so that it can be replaced. However, in all prior proposed darts the point portion has been directly mounted on the barrel, and special tools have been required to remove a broken point from the barrel and to introduce a fresh point to the barrel. However in a dart in accordance with the present invention, it is now also possible for the point portion to be readily removed by unscrewing the screw thread 8 from the barrel portion 2 and then screwing in a replacement point portion.

In the dart described above with reference to FIG. 1, the screw thread 8 of the point portion 1 and the screw thread 12 of the shaft 3 are of the same diameter as one another. Thus, instead of screwing the shaft 3 into the end 11 of the barrel portion 2 as described above, it is possible to screw the shaft 3 into the other end 9 of the barrel portion 2 and to screw the point portion 1 into the end 11 of the barrel portion 2 into which the shaft 3 was originally screwed. If the barrel portion 2 is of an axially asymmetric construction with regard to weight, such a transposition of the shaft 3 and the point portion 1 enables the balance of the dart to be changed radically and, in effect, allows two darts to be purchased for the price of one.

Figure 2:
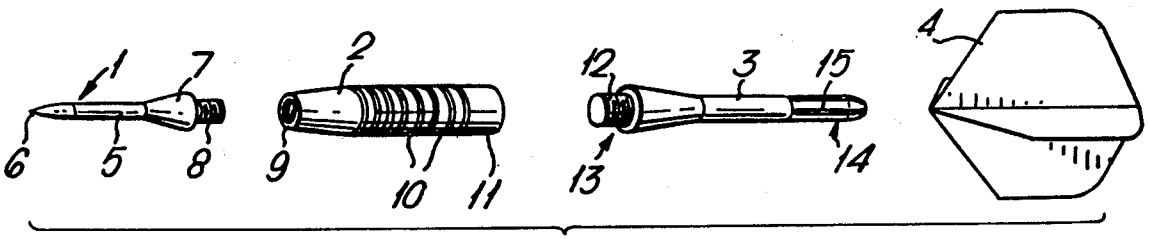
FIG. 2 is a side elevation of another dart in accordance with the invention, with the various components thereof exploded away from one another.

In an alternative form of construction, shown in FIG. 2, the diameter of the screw thread 8 of the point portion 1 differs from the diameter of the screw thread 12 of the shaft 3. The point portion 1 and the shaft 3 cannot therefore be transposed. If, for example, the barrel portion 2 of such a dart is provided with a small diameter screw thread at the first end 9 and a large diameter screw thread at the second end 11, then it will be appreciated that the diameter of the screw thread of the point portion 1 will be smaller than the diameter of the screw thread 12 of the shaft 3. However, it is possible to provide with such a dart a second point portion provided with a relatively large diameter screw thread adapted to be screwed into the large diameter screw thread of the barrel portion 2, and to provide a second shaft, provided with a relatively small diameter screw thread adapted to be screwed into the small diameter screw thread of the barrel portion 2. Thus it can be seen that, not only can the orientation of the barrel portion 2 be reversed with respect to the direction of travel of the dart, but a large diameter shaft can be exchanged for a small diameter shaft, and a small diameter point portion can be exchanged for a large diameter point portion.

Whilst, in the darts described above with reference to the accompanying drawings, the means for detachably securing the point portion 1 to the barrel portion 2 comprises a screw thread, it will be appreciated that other means for detachably securing the point portion 1 to the barrel portion 2 may be employed, for example a "bayonet" means of the type commonly used with British domestic light bulbs.

In preferred embodiments, the two important features of the means for detachably securing the point portion to the barrel portion are (a) that it must allow the two components to be detached readily from one another by hand and (b) that it must be sufficiently secure for the dart to be repeatedly plucked from the target board used in the game of darts without the barrel portion's becoming detached from the point portion.

Figure 3:
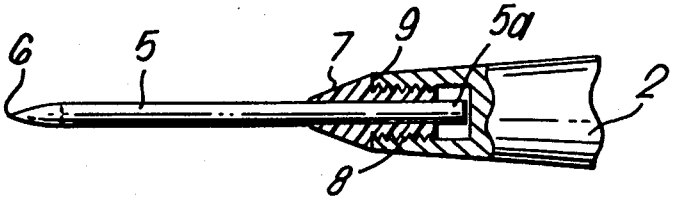
FIG. 3 is a fragmentary vertical section through another dart in accordance with the invention, on an enlarged scale.

In the specific embodiment described above, the point portion is held in the barrel merely by the screw-thread 8 of the securing member 7. Whilst this is satisfactory if suitable material is chosen for the securing member, in an alternative embodiment, illustrated in FIG. 3, the blunt end of the point 5 extends beyond the securing member 7 to provide a protruding portion 5*a* adapted, for example, to engage snugly a corresponding recess (not shown) in the first end 9 of the barrel 2. There is thus a strong metal-to-metal connection between the point portion and the barrel, thereby allowing a relatively weak material to be used for the securing member 7 without danger of there being an unacceptably high degree of flexibility between the point and the barrel. It is thought that if there is any substantial degree of flexibility or resilience between the point and the barrel, a dart may tend to fall out of a dart board due to the movement of the barrel after the dart hits the dart board.

It will be appreciated that, whereas in the specific embodiments described above with reference to the drawings, the central diameter of the barrel portion 2 was slightly greater than the two end diameters, the barrel portion could alternatively be a right cylinder so that the central diameter is the same as the two end diameters. Furthermore, the number of circumferential grooves 10 in the barrel portion 2 may be varied, or there may be no such grooves at all.

I claim:

1. A kit of parts for forming a dart, the kit comprising: a barrel which is longitudinally asymmetric and which has two ends; shaft means for connection to the barrel, point means for connection to the barrel, said point means comprising at least two points, a first said point being adapted to be detachably secured only to a first end of the barrel and a second said point being adapted to be detachably secured only to the second end of the barrel, said shaft means comprising at least two shafts, a first said shaft being adapted to be detachably secured only to a first end of the barrel and a second said shaft being adapted to be detachably secured only to the second end of the barrel, and at least one flight adapted to be secured to any one of the shafts, and wherein from said kit, a dart can be made comprising a point secured detachably to one said end of the barrel and a shaft and flight secured detachably to the other said end of the barrel and alternatively, a dart may be made comprising a point secured detachably to the said other end of the barrel, and a shaft and flight secured detachably to the said one end of the barrel.

2. A dart comprising an elongate barrel which is longitudinally asymmetric and which has two ends; point means mounted in a securing member comprising a threaded collar for connection to a threaded bore of the barrel, said point means being such that the point can be secured detachably to a threaded bore in a first said end of the barrel or to a threaded bore in a second said end of the barrel, said point means comprising at least two points, a first said point being adapted to be detachably secured only to a first end of the barrel and a second said point being adapted to be detachably secured only to the second end of the barrel; shaft means with a threaded end for connection to the barrel, said shaft means being such that said threaded end can be secured detachably to said threaded bore in the first end of the barrel or said threaded bore in the second end of the barrel, said shaft means comprising at least two shafts, a first said shaft being adapted to be detachably secured only to a first end of the barrel and a second said shaft being adapted to be detachably secured only to the second end of the barrel, and at least one flight adapted to be secured to any one of the shafts; and flight means adapted to be secured detachably to the other end of the said shaft means remote from the threaded end, the construction being such that a dart can be assembled having different characteristics with the point secured detachably to one said end of the barrel and a shaft and flight secured detachably to the other said end of the barrel, and, alternately, a point secured detachably to the said other end of the barrel, and a shaft and flight secured detachably to the said one end of the barrel.

3. A dart as claimed in claim 2 wherein, the diameter of the said screw thread at one end of the barrel is different from the diameter of the screw thread at the other end of the barrel.

* * * * *